United States Patent [19]

Sandowicz et al.

[11] 4,217,080

[45] Aug. 12, 1980

[54] MACHINE FOR MOLDING PIPE-TYPE ELEMENTS SUCH AS STEEL FABRIC REINFORCED CONCRETE PIPES

[75] Inventors: Michal Sandowicz; Krzysztof Wiaderek; Waldemar Hamann, all of Warsaw, Poland

[73] Assignee: Politechnika Warszawska, Warsaw, Poland

[21] Appl. No.: 909,415

[22] Filed: May 25, 1978

[30] Foreign Application Priority Data

May 30, 1977 [PL] Poland ..... 198517

[51] Int. Cl.[2] ..... B28B 7/38; B28B 21/14; B28B 21/22; B28B 21/56

[52] U.S. Cl. ..... 425/95; 264/69; 425/107; 425/117; 425/426; 425/456

[58] Field of Search ..... 264/71, 69; 425/107, 425/427, 262, 449, 117, 456, 95, 426

[56] References Cited

U.S. PATENT DOCUMENTS

| | | | |
|---|---|---|---|
| 430,752 | 6/1890 | Raymond | 425/107 |
| 1,124,846 | 1/1915 | Brennan | 425/107 X |
| 1,137,776 | 5/1915 | Miller | 425/449 X |
| 1,320,707 | 11/1919 | Pauly | 425/107 X |
| 1,590,429 | 6/1926 | Emert | 425/107 |
| 1,838,546 | 12/1931 | Halstead | 425/95 |
| 3,047,929 | 8/1962 | Steiro | 264/23 |
| 3,453,706 | 7/1969 | Chanlund | 425/107 X |
| 3,551,968 | 1/1971 | Fosse et al. | 425/117 X |

FOREIGN PATENT DOCUMENTS

| | | | |
|---|---|---|---|
| 824022 | 12/1951 | Fed. Rep. of Germany | 425/262 |
| 27095 | 1/1955 | Finland | 425/262 |
| 164483 | 10/1933 | Switzerland | 425/427 |
| 378816 | 8/1932 | United Kingdom | 425/107 |
| 153680 | 10/1963 | U.S.S.R. | 425/262 |

*Primary Examiner*—Philip Anderson
*Attorney, Agent, or Firm*—Edwin E. Greigg

[57] ABSTRACT

A machine for molding pipe type elements such as steel fabric reinforced concrete pipes, provided with a funnel having protrusions on its inner surface mounted rotatably in relation to an external mold on rolling elements, a core tube being provided with preferably three guiding members arranged inside the core tube, at least one of the guiding members being filled with lubricating liquid and a seat at the lower ends of the guiding members fitted separably with a lubricating gasket, the seat consisting of at least two parts arranged symmetrically about a cylinder whereby the inner opening of the seat is fitted slidably to the outer diameter of the cylinder with the guiding members guided slidably in the openings of a guide forming the tip of the cylinder.

5 Claims, 3 Drawing Figures

MACHINE FOR MOLDING PIPE-TYPE ELEMENTS SUCH AS STEEL FABRIC REINFORCED CONCRETE PIPES

This invention relates to a machine for moulding of pipe-type elements, especially of steel fabric reinforced concrete pipes used for sewerage systems and water-pipe networks.

BACKGROUND OF THE INVENTION

A machine for molding of steel fabric reinforced concrete pipes is known, consisting of an external mold and a core tube, the mold and tube being arranged vertically and coaxially in such way that they can be displaced concentrically in relation to each other. At the upper end of the external mold a funnel is mounted separably, forming an extension of the external mold. The core tube, however, is provided at its lower end with a stop collar mounted separably and fitted to the internal diameter of the external mold so that there is formed between the external mold and the core tube, a ring-shaped space, whereby the external mold and the funnel can be vibrated together.

A disadvantage of such a machine is the lack of lubrication of the inner surface of the external which makes it difficult to remove the steel fabric reinforced concrete pipe produced in the molding process from the inside of the outer mold. A further disadvantage is also that an important part of energy used for vibrating is absorbed by the external mold together with the funnel which makes it necessary to employ vibrators with great force for generating the vibrations.

OBJECTS, SUMMARY AND ADVANTAGES OF THE INVENTION

The machine according to the invention has the funnel mounted rotatably in relation to the external mold. The core tube, however, includes preferably three guiding members, being guided slidably in opening of a guide forming the tip of an hydraulic cylinder, and being arranged inside the core tube. At least one of the guiding members is filled with lubricating liquid. Moreover, at the lower ends of the guiding members a seat with a lubricating gasket is fitted separably, consisting of at least two parts disposed symmetrically about the hydraulic cylinder, the inner opening of the seat being slidably fitted to the inner diameter of said cylinder.

The funnel forming an extension of the external mold is mounted rotatably on rolling elements, and the inner surface of the funnel is provided with protrusions disposed radially.

In the course of manufacturing the steel fabric reinforced concrete pipes according to the invention the inner surface of the external mold is continuously lubricated with lubricating liquid which facilitates the removal of the steel fabric reinforced concrete pipe from the external mold, and prevents the adhesion of the concrete mix to the sliding surface of the mold. Moreover, simultaneously with the vibrating of the concrete mix in the funnel, the funnel is rotated so that a uniform preliminary vibrating of the concrete mix is achieved, which facilitates the flowing of said concrete mix into the space contained between the external mold and the core tube, wherein the steel fabric reinforcement is placed.

BRIEF DESCRIPTION OF THE DRAWINGS

The subject of the invention will be now described in particular as an exemplary embodiment with reference to the accompanying drawing, wherein.

DESCRIPTION OF THE PREFERRED EMBODIMENT

Figure 1:
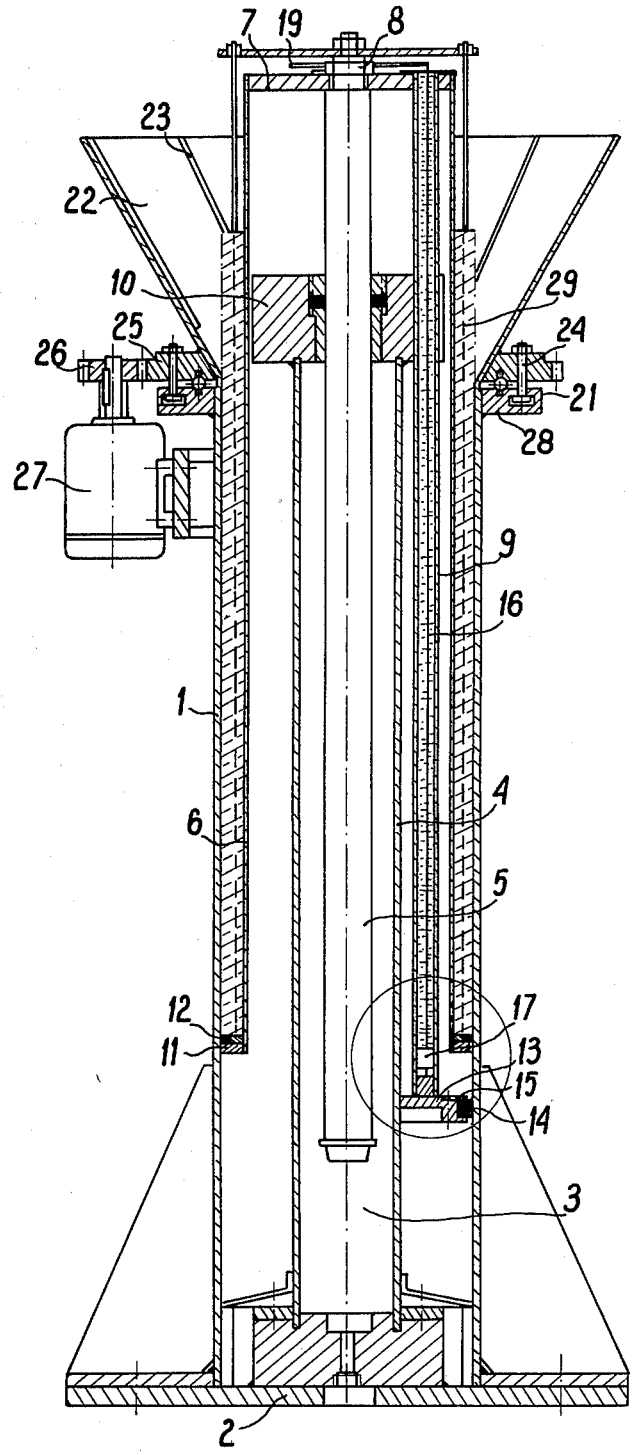
FIG. 1 is the longitudinal sectional view of the machine for molding steel fabric reinforced concrete pipes according to the invention.
Figure 2:
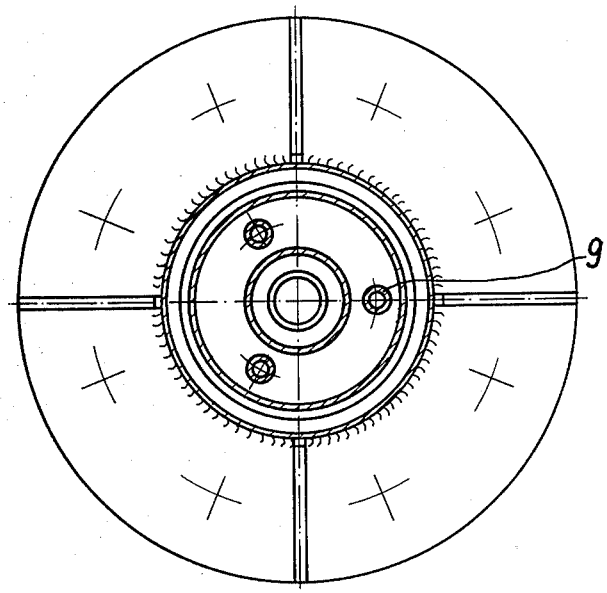
FIG. 2 is a cross-sectional view of the machine.
Figure 3:
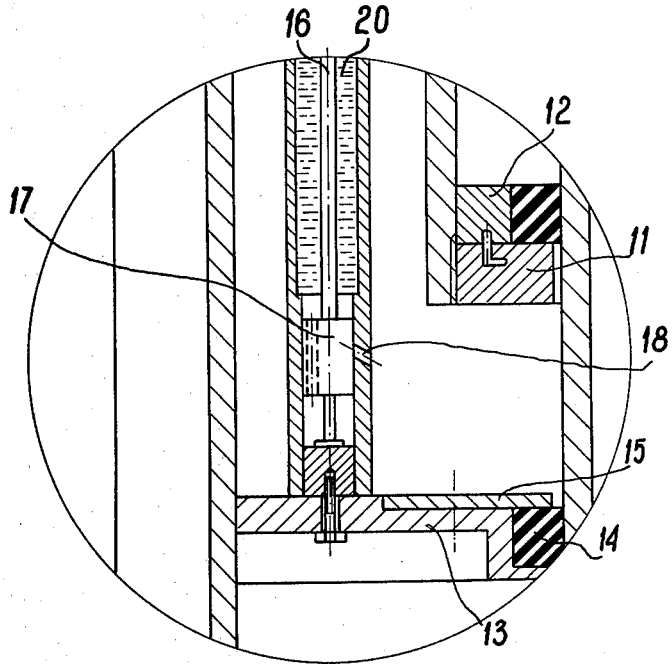
FIG. 3 is an enlarged cross-sectional view of a fragment of the machine.

As shown in FIGS. 1, 2 and 3 of the drawing, an external mold 1 is mounted vertically in a mount 2 in which a hydraulic cylinder 3 consisting of a cylinder 4 a plunger 5 is mounted. On the plunger 5, a core tube 6 is placed, being fastened to the plunger through a cover 7 by means of a nut 8. Inside the core tube 6 three guiding members 9 are located, with their upper ends fitted separably in the cover 7, and guided slidably in openings of a guide 10 forming the tip of the cylinder 4 of the hydraulic cylinder 3. At the lower end of the core tube 6 a ring 11 is fastened by a threaded connection to which a stop collar 12 is fastened separably, made in the form of a metal ring with a rubber ring being vulcanized thereon. At the lower ends of the guiding members 9, however, a seat 13 is fitted separably, consisting of two half-rings with a collar, the inner opening of which is slidably fitted to the outer diamater of the cylinder 4. Lubricating gaskets 14 are placed in the collar of the half-rings of the seat 13 and fastened to the seat by a pressing plate 15. Each of the guiding members 9 is provided with a tie rod 16 placed inside the member and terminating in a piston 17 closing an outlet opening 18 situated in the lower part of the guiding member 9 which is filled with a lubricating liquid 20. Each tie rod 16 is fastened separably in a holder 19 used to displace the tie rod in a vertical direction.

In the upper part of the external mold 1, on rolling elements 21, a funnel 22 is arranged, having radial protrusions 23 provided on the inner surface thereof. The funnel 22 is, moreover, guided by means of pins 24 located on a collar 25 of the funnel 22. On the periphery of the collar a toothed rim is provided, co-operating with a toothed gear 26 mounted on the shaft of motor 27, the pins 24 being fitted slidably in a channel 28 of the external mold 1. Inside of the mold 1 a steel fabric reinforced concrete pipe 29 is molded.

The machine operates as follows:

After placing the steel fabric reinforcement onto the core tube 6, the core tube is displaced into its upper position by means of the hydraulic cylinder 3. Then the concrete mix is charged into the funnel 22 and vibrated by means of known immersion vibrators.

Molding of the steel fabric reinforced concrete pipe 29 starts at the moment of the downward movement of the core tube 6 with simultaneous rotation of the funnel 22 by means of the motor 27 through the gear 26. The rotating funnel 22, due to being provided with protrusions 23, enables a better vibrating of the concrete mix, which facilitates the flowing of the mix into and through the steel fabric reinforcement. Moreover, before beginning the molding of the steel fabric reinforced concrete pipe 29, the tie rods 16 are lifted up, then the piston 17 opens the outlet opening 18, so that the lubricating liquid 20 wets the lubricating gasket 14. Thereafter the piston 17 closes the outlet opening 18, and the lubricating gasket 14 is displaced downward together with the core tube 6 in the course of molding of the steel fabric reinforced concrete pipe 29 and lubricates the inner surface of the external mold 1.

After the core tube 6 reaches the lower position, the molding process of the pipe 29 is completed. Simultaneously, in the course of molding the steel fabric reinforced concrete pipe 29 the stop collar 12 prevents the concrete mix from penetrating into the space between the seat 13 and the ring 11.

Then, the steel fabric reinforced concrete pipe 29 together with the core tube 6 is pushed upwards, where, after removing, it is fastened to the holder, and the core tube 6 is shifted downwards in order to place the steel fabric reinforcement for the next steel fabric reinforced concrete pipe 29 to be molded.

What is claimed is:

1. A machine for molding tubular elements such as steel fabric reinforced concrete pipe comprising in combination, a tubular external mold, means for supporting said external mold in an upstanding position, a core tube disposed concentrically within said external mold with the outer surface of said core tube in spaced-apart relationship with the inner wall of said external mold to define an annular mold cavity, separable stop means mounted on the lower end of said core tube for sliding engagement with the inner surface of said external mold, means for moving said core tube reciprocally within said external mold, a funnel rotatably mounted on the upper end of said external mold to form an extension of said external mold, means for rotating said funnel, at least one elongated tubular member mounted to said means for moving said core tube to extend within said core tube such that the lower end thereof is located below the lower end of said core tube and stop means, said tubular member having an inner cavity containing a lubricating liquid, an annular seat member mounted on the lower end of said tubular member, a lubricating gasket mounted on the outer periphery of said annular seat member for sliding engagement with the inner wall of said external mold below the lower end of said core tube and valve means in said tubular member for introducing said lubricating fluid into said external mold for absorption by said gasket.

2. A machine in accordance with claim 1, wherein said means for moving said core tube comprises a hydraulic cylinder disposed within said external mold and mounted to said means for supporting said external mold, and wherein said annular seat member comprises at least two parts displaced symmetrically around the outer surface of said hydraulic cylinder with the inner edge of the central opening in said annular seat member in sliding engagement with the outer surface of said hydraulic cylinder.

3. A machine in accordance with claim 1, wherein a pluraliy of tubular members are provided, each mounted to said means for moving, said core tube, said plurality of tubular members serving as guide members with at least one of said tubular members having the inner cavity containing the lubricating liquid, and wherein said means for moving said core tube comprises a hydraulic cylinder disposed iwthin said external mold and a guide member at the upper end of said hydraulic cylinder forming a closure for said upper end, said guide member having a plurality of openings formed therein each arranged to slidably receive one of said guiding members.

4. A machine in accordance with claim 1, wherein the inner surface of said funnel is provided with a plurality of protrusions.

5. A machine in accordance with claim 1, including rolling elements on said external mold forming bearing means for rotatably supporting said funnel.

* * * * *